US006224181B1

(12) United States Patent
Koitabashi

(10) Patent No.: US 6,224,181 B1
(45) Date of Patent: May 1, 2001

(54) INK JET RECORDING HEAD HAVING MULTI-HEATER AND SYSTEM THEREFOR

(75) Inventor: Noribumi Koitabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/176,337

(22) Filed: Oct. 22, 1998

(30) Foreign Application Priority Data

Oct. 24, 1997 (JP) ..... 9-292650

(51) Int. Cl.[7] ..... B41J 2/205; B41J 2/14
(52) U.S. Cl. ..... 347/15; 347/48
(58) Field of Search ..... 347/48, 60, 15, 347/63, 65, 10, 11

(56) References Cited

U.S. PATENT DOCUMENTS

| | | | | |
|---|---|---|---|---|
| 4,251,824 | * | 2/1981 | Hara et al. | 347/48 |
| 5,166,699 | | 11/1992 | Yano et al. | 346/1.1 |
| 5,367,325 | | 11/1994 | Yano et al. | 347/17 |
| 5,479,196 | * | 12/1995 | Inada | 347/60 |
| 5,559,535 | * | 9/1996 | Otsuka et al. | 347/11 |
| 5,841,448 | | 11/1998 | Moriyama et al. | 347/19 |

FOREIGN PATENT DOCUMENTS

| | | |
|---|---|---|
| 0 719 647A2 | 7/1996 | (EP) . |
| 0 719 647A3 | 7/1996 | (EP) . |
| 0 816 084 | 1/1998 | (EP) . |
| 0 894 625 | 2/1999 | (EP) . |
| 2 292 117 | 2/1996 | (GB) . |
| 55-132259 | 10/1980 | (JP) . |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharge recording method utilizing two electrothermal transducing members to be driven independently provided in a liquid path communicating with a discharge opening at different distances OH from the discharge opening, and adapted to discharge liquid by bubble generation caused by heat generation in the electrothermal transducing members, in which an electrothermal transducing member positioned farther from the discharge opening is placed within an area where a ratio v/Vd of a discharge speed v to a discharge amount Vd of the liquid discharged by heating with the electrothermal transducing member remains substantially constant with respect to the distance OH, while the other electrothermal transducing member positioned closer to the discharge opening is placed in an area closer to the discharge opening than the above-mentioned range; and the bubble generation by the electrothermal transducing member positioned farther from the discharge opening is delayed by a predetermined time from the bubble generation by the electrothermal transducing member positioned closer to the discharge opening, the predetermined time being variable to vary the discharge amount of the liquid.

34 Claims, 14 Drawing Sheets

FIG. 13

| | DELAY IN DRIVE TIMING | DELAY IN FOAM TIMING | Vd (PI) | v (m/s) |
|---|---|---|---|---|
| A | 0 μs | 2.5 μs | 15 | 13 |
| B | 1.0 μs | 1.5 μs | 21 | 15 |
| C | 1.5 μs | 1.0 μs | 30 | 16.5 |
| D | 2.0 μs | 0.5 μs | 40 | 18 |
| E | 2.5 μs | 0 μs | 37 | 17.5 |

INK JET RECORDING HEAD HAVING MULTI-HEATER AND SYSTEM THEREFOR

BACKGROUND OF THE INVENTION

1. Field of the Invention

The present invention relates to an ink jet recording head having a plurality of heat generating elements such possible to be driven independently in a liquid path, and also to ink jet recording method and ink jet recording apparatus utilizing such ink jet recording head.

2. Related Background Art

Most of ink jet recording apparatuses are known as printing devices used in a printer, a facsimile, a word processor, a copying maching and so on. Among such ink jet recording appartatuses, there is already known an appartus utilizing thermal energy as energy for ink discharge so as to generage bubbles and thereby achieve discharge of ink. Recently, this type of ink jet recording apparatus has been known as an ink jet printing apparatus for printing a fixed pattern or design or a synthesized image on the textiles.

The ink jet recording head employed in the above-mentioned ink jet recording apparatus utilizes an electrothermal transducer element (hereinafter called heater) as means for generating thermal energy. The ink jet recording head usually has a configuration with the heater in each ink path (hereinafter called liquid path) (such configuration being hereinafter called single-heater configuration). On the other hand, there is known an ink jet recording head having a configuration with plural heaters in each ink path (hereinafter called multi-heater configuration), for achieving the following objectives.

Firstly, plural heaters are activated (for heat generation) alternately or one by one, in order to extend a service life of the ink jet recording head.

Secondly, plural heaters are employed in order to increase the range of change in an ink discharge amount for reproducing gradation, and the ink discharge amount is varied by selecting the heaters to be activated or determining the number of heaters to be activated.

In the latter case, in a more specific structure, plural heaters are positioned along a discharge direction of ink in an ink path leading to a discharge opening. The ink discharge amount is changed by varying the distance between the respective activated heater and the discharge opening, through the selection of heaters to be activated or the determination of the number of heaters to be activated.

There is also disclosed, as in the Japanese Patent Laid-open Application No. 55-132259, for example, another configuration in which plural heaters of respectively different surface areas are positioned in each ink path, and an ink discharge amount is varied by the selection of heaters to be activated or determination of the number of heaters to be activated.

Among the prior techniques mentioned above, the multi-heater configuration can realize various discharge amounts by shifting a timing of activation of a heater. In order to meet the requirement of higher image quality requested recently to a recording if apparatus, there has been proposed a technique of achieving modulation of a record image by modulating a liquid discharge amount from a discharge opening using the multi-heater configuration. This type of recording apparatus is being gradually commercialized.

In an ink jet recording head with the multi-heater configuration, a liquid discharge amount can be modulated by shifting a timing of activation of a heater. But a certain long is required for shifting the timing. For this reason, it has been relatively difficult to apply the discharge amount modulating technology based on the multi-heater configuration, to a high-speed printer provided with a plurality of discharge nozzles. Also, the configuration of a drive circuit becomes inevitably complex, because drive signals of different timings have to be supplied to heaters provided for each nozzle.

Besides, in case of the discharge amount modulation, an ink discharge speed fluctuates corresponding to the change in the ink discharge amount, whereby a landing position of an ink droplet fluctuates. Also, even in case the discharge amount modulation is not employed, though the ink discharge amount fluctuates little, if an actual timing of activation fluctuates from a predetermined timing, the ink discharge speed fluctuates and thus the landing position of the ink droplet fluctuates. This fluctuation in the landing position of the ink droplet results in deterioration of the image quality.

SUMMARY OF THE INVENTION

The present invention has been created taking into consideration the above-mentioned drawbacks of the prior technology, and is directed to provision of a liquid discharge recording head capable, in modulating a liquid discharge amount with the multi-heater configuration, of being driven at high speed with easy driving method, thereby achieving a stable discharge speed, and provision of recording method and apparatus utilizing such recording head.

Another object of the present invention is to provide a liquid discharge recording head capable, in discharging liquid with the multi-heater configuration, of achieving a stable discharge speed even there occurs a fluctuation in a timing of driving, and to provide recording method and apparatus utilizing such recording head.

According to the present invention, there is provided a liquid discharge recording method for discharging liquid by providing two electrothermal transducing members to be driven independently, in a liquid path communicating with a discharge opening, at respectively different distances OH from the discharge opening and effecting liquid discharge by bubble generation caused by heat generation in the electrothermal transducing members, the method comprising:

positioning an electrothermal transducing member farther from the discharge opening within an area where a ratio v/Vd of a discharge speed v to a liquid amount Vd discharged by the activation of the electrothermal transducing member remains substantially constant with respect to the distance OH, while positioning the other electrothermal transducing member closer to the discharge opening in an area closer to the discharge opening than the above-mentioned area; and relatively delaying the bubble generation by the electrothermal transducing member positioned farther from the discharge opening by a predetermined time from the bubble generation by the electrothermal transducing member positioned closer to the discharge opening, the predetermined time being variable to vary the discharge amount of the liquid.

According to the present invention, there is also provided a liquid discharge recording apparatus in which two electrothermal transducing members to be driven independently are provided, in a liquid path communicating with a discharge opening, at respectively different distances OH from the discharge opening and liquid discharge is effected by bubble generation caused by heat generation in the electrothermal transducing members, the apparatus comprising:

a recording head in which an electrothermal transducing member farther from the discharge opening is provided within an area where a ratio v/Vd of a discharge speed v to a liquid amount Vd discharged by the activation of the electrothermal transducing member remains substantially constant with respect to the distance OH, while the other electrothermal transducing member closer to the discharge opening is provided in an area closer to the discharge opening than the above-mentioned area; and drive means for relatively delaying the bubble generation by the electrothermal transducing member positioned farther from the discharge opening by a predetermined time from the bubble generation by the electrothermal transducing member positioned closer to the discharge opening, the predetermined time being variable to change the discharge amount of the liquid.

According to the present invention, there is also provided a liquid discharge recording head in which two electrothermal transducing members to be driven independently are provided, in a liquid path communicating with a discharge opening, at respectively different distances OH from the discharge opening and liquid discharge is effected by bubble generation caused by heat generation in the electrothermal transducing members, the head comprising:

a recording head unit in which an electrothermal transducing member farther from the discharge opening is provided within an area where a ratio v/Vd of a discharge speed v to a liquid amount Vd discharged by the activation of the electrothermal transducing member remains substantially constant with respect to the distance OH, while the other electrothermal transducing member closer to the discharge opening is provided in an area closer to the discharge opening than the above-mentioned area; and a drive unit for relatively delaying the bubble generation by the electrothermal transducing member positioned farther from the discharge opening by a predetermined time from the bubble generation by the electrothermal transducing member positioned closer to the discharge opening, the predetermined time being variable to change the discharge amount of the liquid.

In another embodiment of the present invention, there is provided a liquid discharge recording method for discharging liquid by providing two electrothermal transducing members to be driven independently, in a liquid path communicating with a discharge opening, at respectively different distances OH from the discharge opening and effecting liquid discharge by bubble generation caused by heat generation in the electrothermal transducing members, the method comprising:

a positioning an electrothermal transducing member farther from the discharge opening within an area where a ratio v/Vd of a discharge speed v to a liquid amount Vd discharged by the activation of the electrothermal transducing member remains substantially constant with respect to the distance OH, while positioning the other electrothermal transducing member closer to the discharge opening in an area closer to the discharge opening than the above-mentioned area; and delaying the bubble generation by the electrothermal transducing member positioned farther from the discharge opening with respect to the bubble generation by the electrothermal transducing member positioned closer to the discharge opening, within a range that the discharge amount of the liquid becomes smaller than in a case in which the bubble generation by the electrothermal transducing member positioned farther from the discharge opening is executed simultaneously with the bubble generation by the closer electrothermal transducing member.

In another embodiment of the present invention, there is also provided a liquid discharge recording apparatus for discharging liquid by providing two electrothermal transducing members to be driven independently, in a liquid path communicating with a discharge opening, at respectively different distances OH from the discharge opening and effecting liquid discharge by bubble generation caused by heat generation in the electrothermal transducing members, the apparatus comprising:

a recording head in which an electrothermal transducing member farther from the discharge opening is positioned within an area where a ratio v/Vd of a discharge speed v to a liquid amount Vd discharged by the activation of the electrothermal transducing member remains substantially constant with respect to the distance OH, while the other electrothermal transducing member closer to the discharge opening is positioned in an area closer to the discharge opening than the above-mentioned area; and drive means for delaying the bubble generation by the electrothermal transducing member positioned farther from the discharge opening with respect to the bubble generation by the electrothermal transducing member positioned closer to the discharge opening, within a range that the discharge amount of the liquid becomes smaller than in a case in which the bubble generation by the electrothermal transducing member positioned farther from the discharge opening is executed simultaneously with the bubble generation by the closer electrothermal transducing member.

In another embodiment of the present invention, there is also provided a liquid discharge recording head for discharging liquid by providing two electrothermal transducing members to be driven independently, in a liquid path communicating with a discharge opening, at respectively different distances OH from the discharge opening and effecting liquid discharge by bubble generation caused by heat generation in the electrothermal transducing members, the head comprising:

a recording head unit in which an electrothermal transducing member farther from the discharge opening is positioned within an area where a ratio v/Vd of a discharge speed v to a liquid amount Vd discharged by the activation of the electrothermal transducing member remains substantially constant with respect to the distance OH, while the other electrothermal transducing member closer to the discharge opening is positioned in an area closer to the discharge opening than the above-mentioned area; and a drive unit for delaying the bubble generation by the electrothermal transducing member positioned farther from the discharge opening with respect to the bubble generation by the electrothermal transducing member positioned closer to the discharge opening, within a range that the discharge amount of the liquid becomes smaller than in a case in which the bubble generation by the electrothermal transducing member positioned farther from the discharge opening is executed simultaneously with the bubble generation by the closer electrothermal transducing member.

Though there have been proposed various ink jet recording heads having plural heaters in a nozzle, the present inventors have obtained the following finding, as a result of investigation on both the arrangement of discharging heaters and the timing of activation (bubble generation).

In a recording head in which heaters are arranged longitudinally in a nozzle from a discharge opening thereof, namely along a direction of a liquid flow, as shown in FIGS. 1A to 1C, discharge characteristics (discharge speed v, discharge amount Vd, refilling frequency fr (frequency of refilling liquid into the nozzle after the liquid discharge)) measured under different timings of activation (bubble generation) are contemplated. In case the heater closer to the discharge opening is activated earlier by about 1.5 to 0.2 $\mu$s than the farther heater, the discharge amount Vd shows a steep change though the discharge speed v did not show a large change, as shown in FIGS. 4A and 4B, and the refilling frequency fr is very satisfactory as shown in FIG. 4C. In FIG. 3 corresponding to the situation in FIG. 4A, a solid line indicates the actual discharge amount Vd in the present invention, while a broken line indicates the discharge amount in case the distance OH from the discharge opening to the heater closer thereto is relatively large.

Such steep change in the discharge amount Vd is considered to be ascribable to the heater positioned closer to the discharge opening. More specifically, even if the discharge amount Vd is large, an actual discharging ability of this heater can be high as indicated by the broken line in FIG. 3. However, the bubble generated by this heater blocks the liquid path go if the heater is positioned closer to the discharge opening, so that the actual discharge amount is limited to the discharge amount caused by activation of only the heater at the side of the discharge opening, if the timing of activation between both heaters is shifted beyond a certain time.

On the other hand, a relatively smooth change of the discharge speed v can be explained by the fact that while the discharge amount Vd substantially proportional to the discharge speed v can be obtained if the liquid path is not blocked by the bubble generated by the heater at the side of the discharge opening, liquid pillar formed by the liquid flow to be discharged is forcedly broken by the bubble generated by the heater at the side of the discharge opening.

Also, in case the front heater (at the side of the discharge opening) is activated at first and the rear heater is activated later, the inertance (resistance of the liquid path) becomes small ahead the front heater but large therebehind, so that, at the activation of the front heater, the ink droplet is discharged with a high discharge speed but little inverse ink flow toward the rear side is generated. Also, since the inertance is large ahead the rear heater and small therebehind, more ink is attracted from the rear side than from the front side at the contraction and vanishing of the bubble generated by activation of the rear heater. Consequently the retraction of the meniscus, resulting from the attraction of the ink present in the front side, is suppressed, and the efficiency of refilling (ink replenishment) is improved by the attraction of the ink present in the rear side. Therefore, in comparison with a case of discharging ink by the activation of the front heater only, the refilling frequency is increased and the high-speed printing is made possible.

BRIEF DESCRIPTION OF THE DRAWINGS

FIG. 13 is a table showing parameters when the parameters shown in FIGS. 6A to 6E are applied.

DESCRIPTION OF THE PREFERRED EMBODIMENTS

Now the present invention will be clarified in detail by embodiments thereof, with reference to the attached drawings.

Figure 1A:
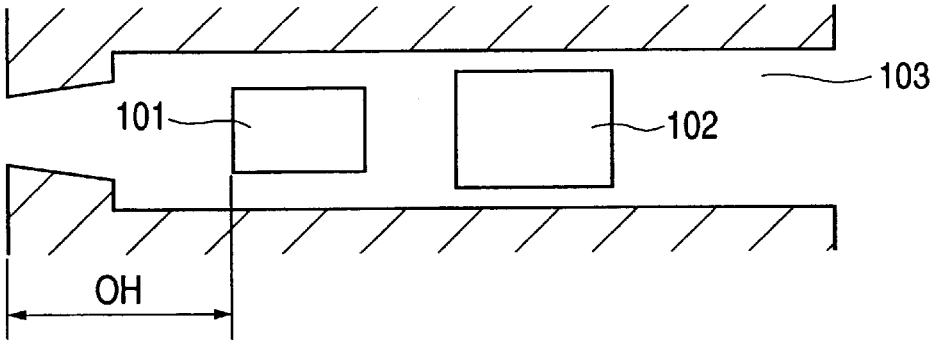
FIGS. 1A, 1B and 1C are plan views showing the configuration of an embodiment of an ink jet recording head of the present invention.

FIG. 1A is a plan view showing the configuration of an embodiment of a recording head of the present invention.

In the present embodiment, two heaters of different sizes are provided longitudinally, from a side of a discharge opening, in a single liquid nozzle 101. A first (or front) heater 101 closer to a discharge opening has a smaller area (smaller width), while a second (or rear) heater 102 farther from the discharge opening has a larger area (larger width).

The positions of the first heater 101 and the second heater 102 will be explained with reference to FIGS. 7 and 8, which show an ink discharge amount Vd and a discharge speed v as a function of a distance OH of the heater from the discharge opening when one heater is activated independently, together with the product of an area So of the discharge opening and the distance OH. In these charts, specific points a, b are defined in the distance OH, and the distance is divided into three areas, namely an area A with the distance larger than a, an area B with the distance smaller than b, and an area C with the distance between a and b.

The specific properties of these areas are as follows. In the area A, the discharge speed v and the discharge amount Vd are approximately proportional to the distance OH, so that v/Vd becomes substantially constant. In the area B. the discharge amount Vd is approximately proportional to the product of the discharge opening area So and the distance OH while the discharge speed v is inversely proportional, so that v/Vd decreases with the increase of the distance OH. In the area C, the discharge amount Vd is approximately constant.

Based on these facts, in case of positioning two heaters of an approximately same size in a single liquid path in consideration of the discharge amount Vd, it is preferable to position the front heater in the area B and the rear heater in the area A in such a manner as to obtain an approximately same discharge amount Vd.

The above-mentioned areas A to C can also be defined as follows, in consideration of each of the as discharge amount Vd and the discharge speed v:

[based on the discharge amount Vd]

The area A: The discharge amount Vd decreases with the increase of the distance OH;

The area B: The discharge amount Vd increases approximately proportionally with the distance OH; and The area C: The discharge amount Vd becomes substantially constant with respect to the distance OH.

[based on the discharge speed v]

The discharge speed v decreases with the increase of the distance OH over the all areas, but the change becomes less particularly in the area A.

In the present invention, the timings of bubble generation are mutually shifted at the activation of plural electrothermal transducing elements provided in a single liquid path. When the same driving pulse is given, at a different timing, to each of the electrothermal transducing elements, the time difference substantially coincides with the shift of generations of bubbles. Consequently, in the following description, it is assumed that same driving pulse is given to each of the electrothermal transducing elements and that the difference in the drive timings is same as the shift in bubble generations, unless otherwise explained. Stated differently, in case the same driving pulse are given to each of the electrothermal transducing elements, the timing of activation is considered substantially same as the timing of bubble generation. The present invention is naturally applicable to a case in which the driving pulses supplied to the respective electrothermal transducing elements are mutually different, but, in such case, the electrothermal transducing element receiving the driving pulse at first does not necessarily effect the bubble generation at first. For example, in case bubble generation in the ink is executed by the application of a pre-heating pulse and a main heat pulse, the bubble generation is controlled by the pre-heating pulse.

Figure 7:
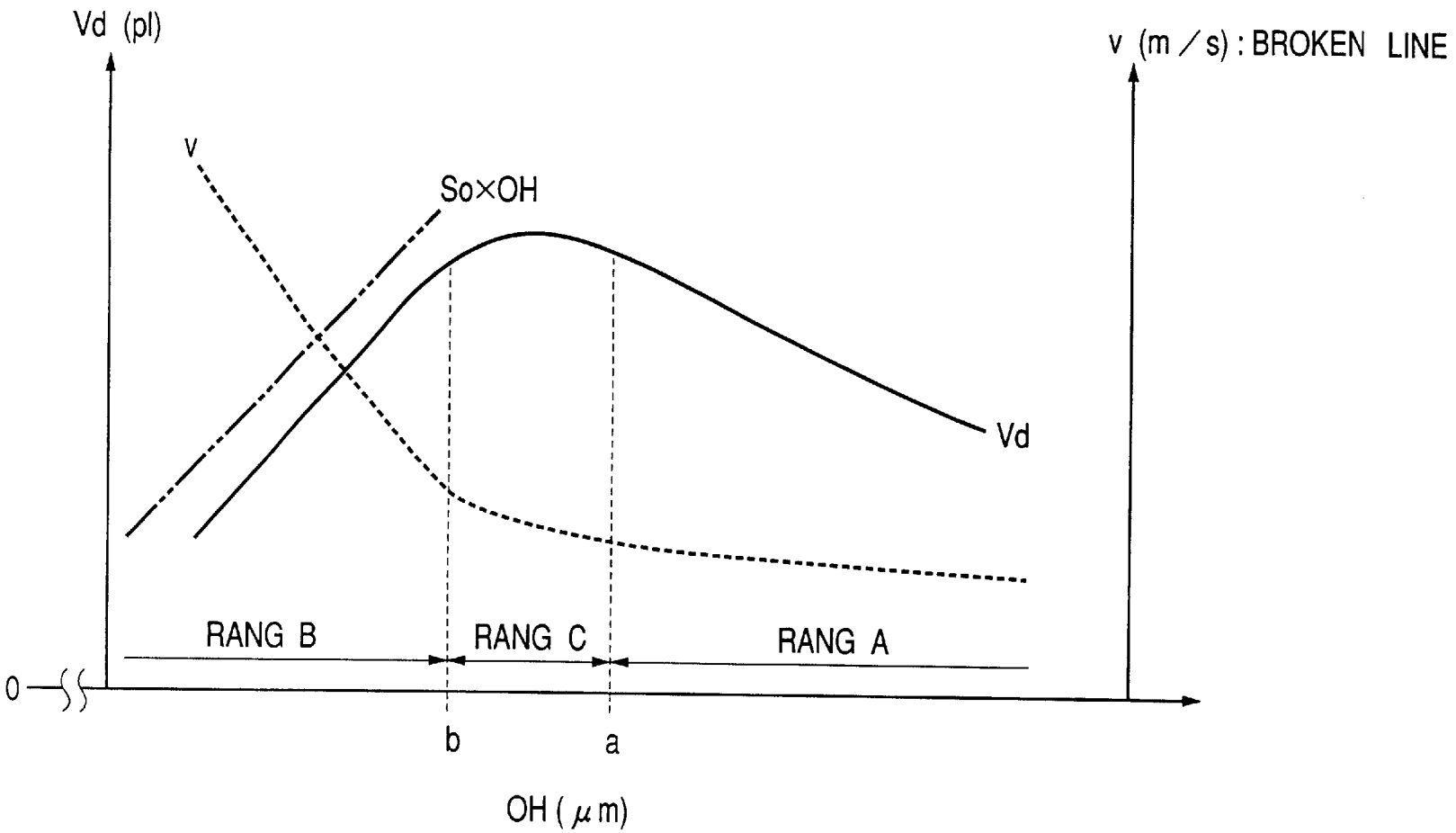
FIGS. 7 and 8 are views showing positions of the first heater 101 and the second heater 102 of the recording head shown in FIGS. 1A to 1C.
Figure 8:
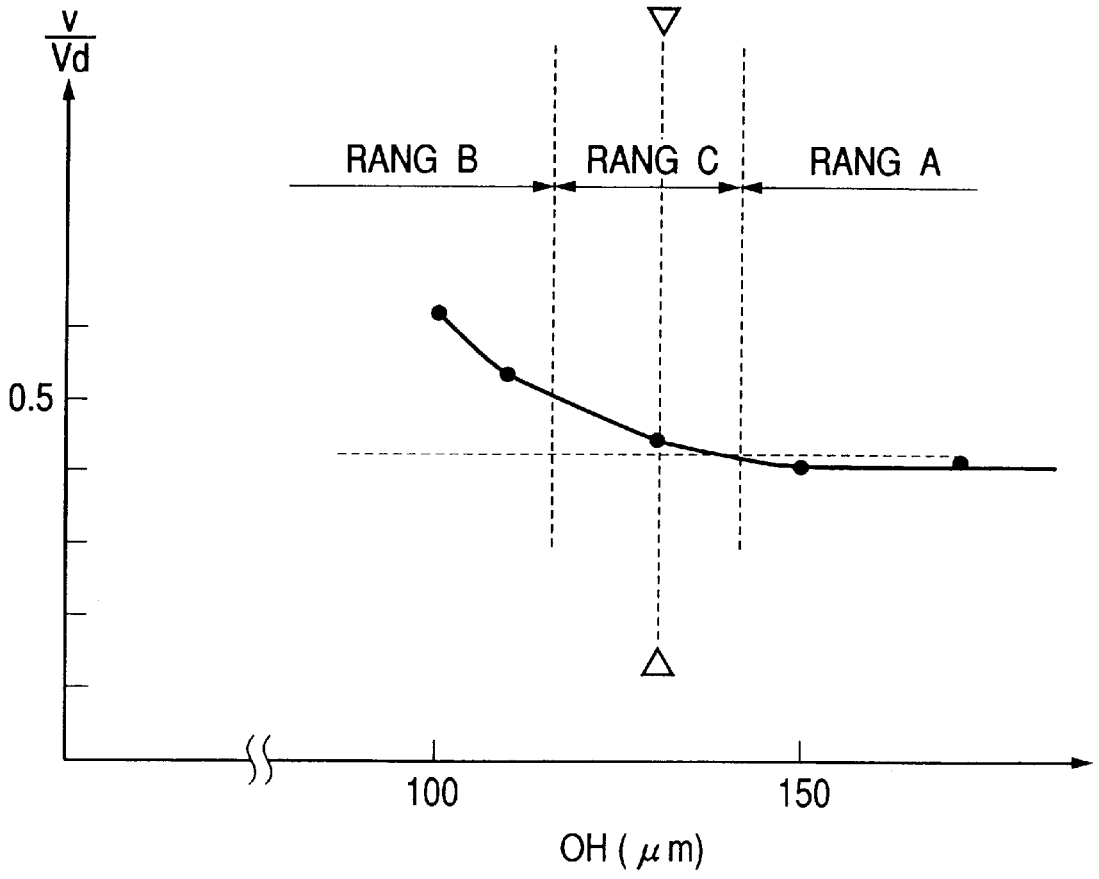

Again referring to FIGS. 1A to 1C, in the present embodiment, the first heater 101 is positioned in the area B shown in FIGS. 7 and 8, while the second heater 102 is positioned in the area A shown in FIGS. 7 and 8. When the first heater 101 in the area B alone is activated, the discharge speed v may be increased while the discharge amount Vd may be decreased.

Figure 4A:
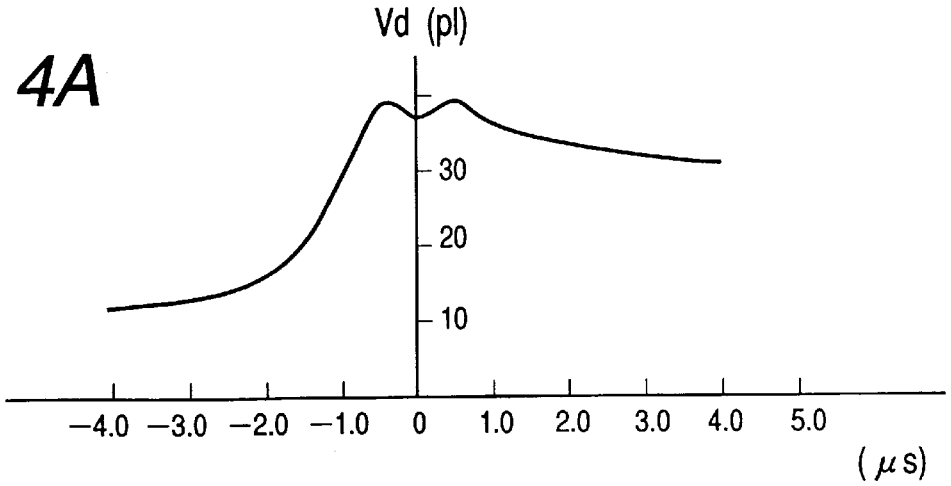
FIGS. 4A, 4B and 4C are charts showing the result of measurement of discharge characteristics (discharge speed v, discharge amount Vd, refill frequency fr (frequency of liquid refilling in the nozzle after the liquid discharge)) in the recording head shown in FIGS. 1A to 1C as a function of timing of activation (bubble generation)
Figure 4B:
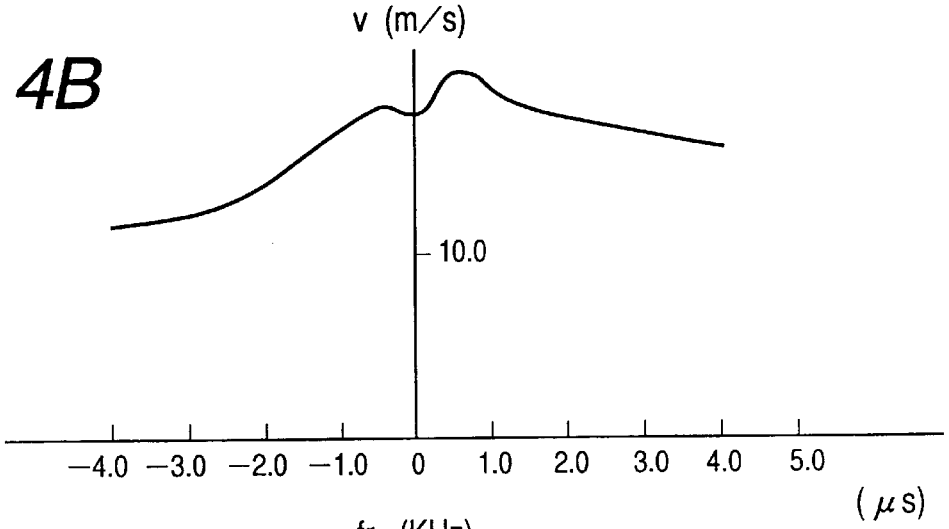
Figure 4C:
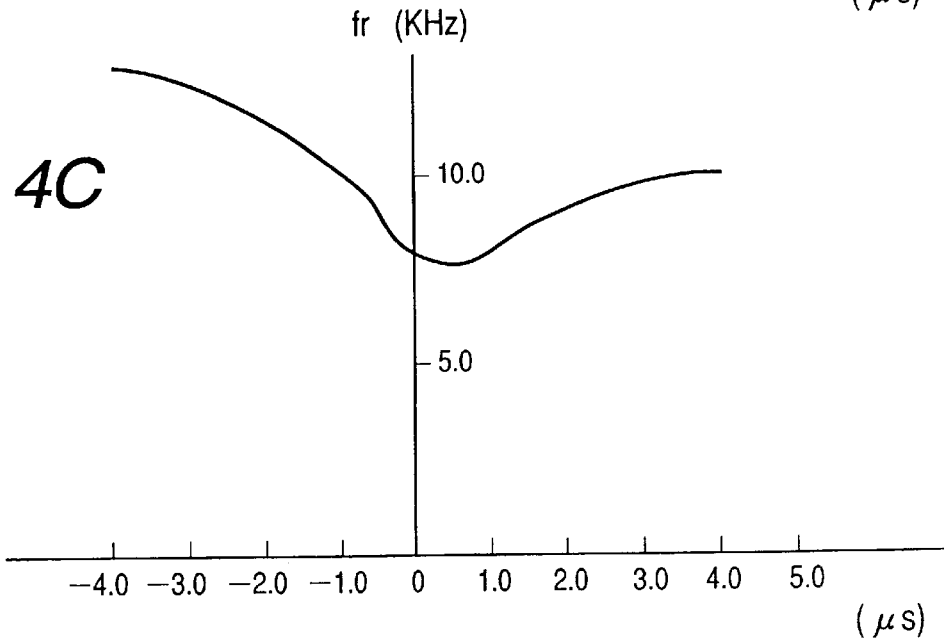
Figure 5A:
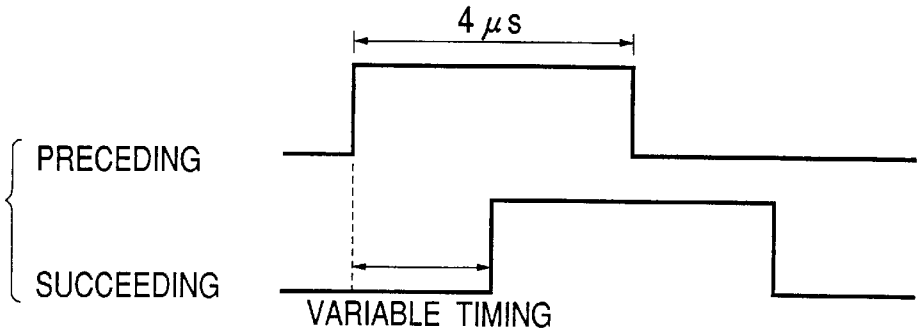
FIGS. 5A, 5B and 5C are views showing examples of driving pulses applied to a first heater 101 and a second heater 102 of the recording head shown in FIGS. 1A to 1C.
Figure 5B:
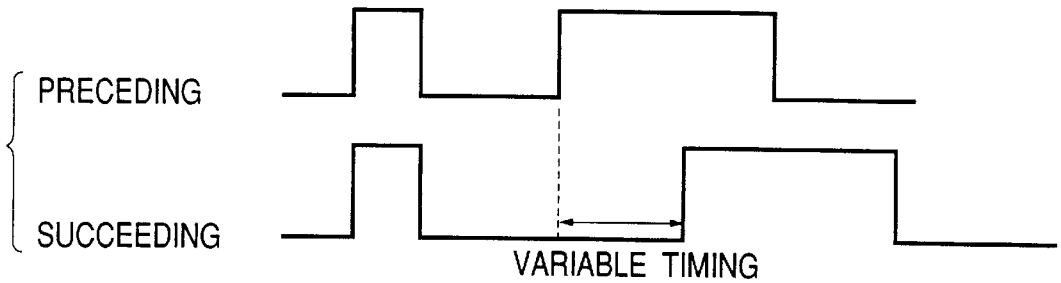
Figure 5C:
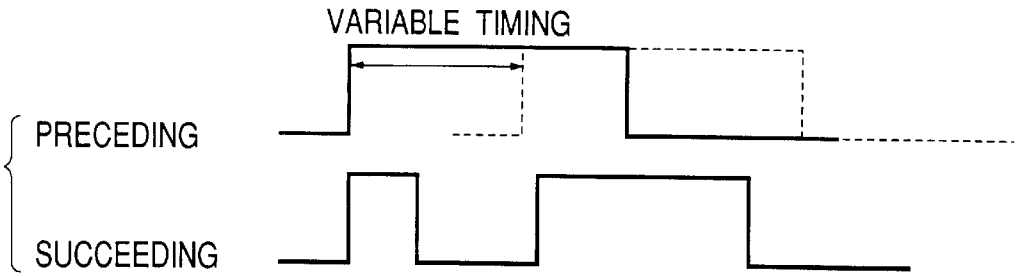

When the timings of activation of the first heater 101 and the second heater 102 are mutually shifted as shown in FIGS. 5A to 5C, there may be achieved various discharge amounts Vd as shown in FIG. 4A, in which the abcissa indicates the difference in the timings of activation of the first heater 101 and the second heater 102, the difference eing taken as positive if the driving pulse is given to the first heater 101 later than the second heater 102, or negative if the driving pulse given to the first heater 101 earlier.

Figure 3:
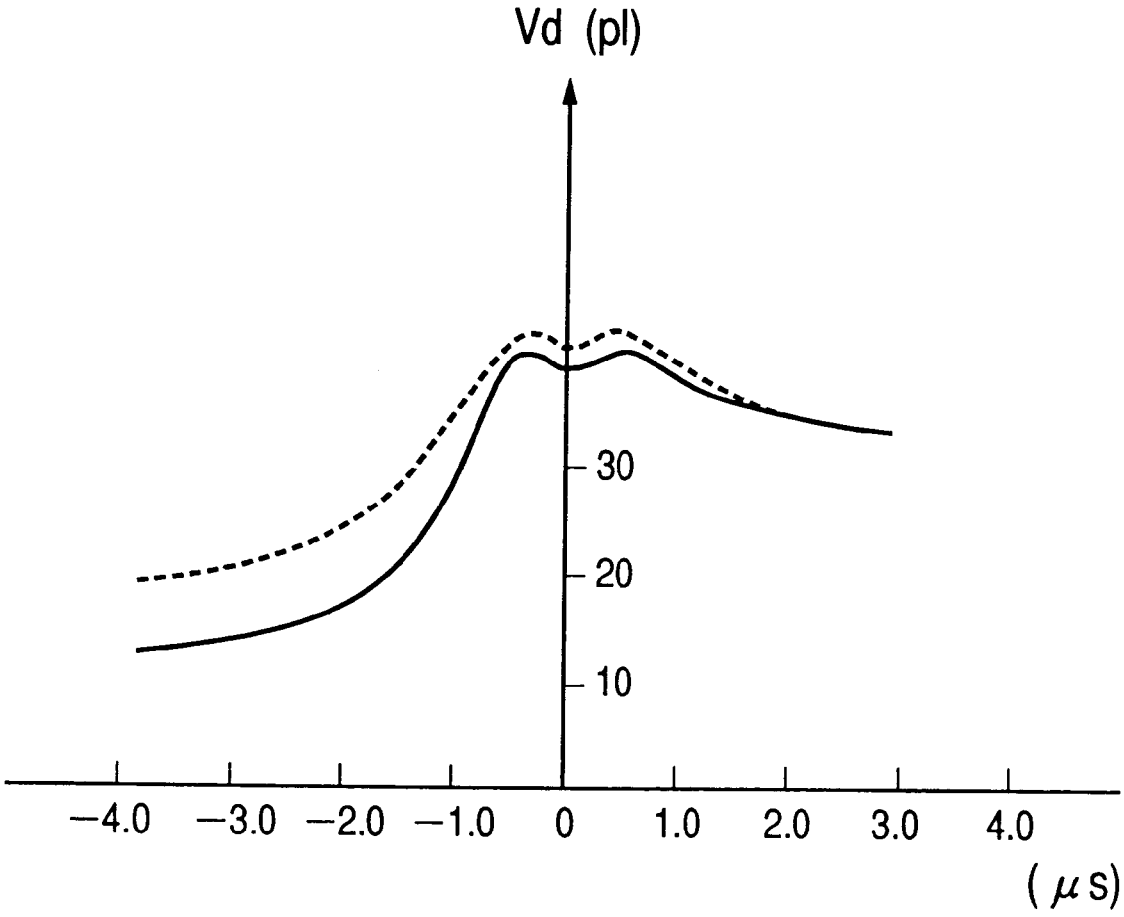
FIG. 3 is a chart of the discharge amount Vd of the recording head shown in FIGS. 1A to 1C as a function of timing of activation (bubble generation)

FIG. 3 corresponding to the situation shown in FIG. 4A, shows the discharge amounts in respectively different distances OH of the front heater, wherein a broken line indicates a case with a larger distance OH than in a case indicated by a solid line. It is also confirmed that a result between the broken line and the solid line is obtained regarding an intermediate distance OH between these distances.

With respect to the driving pulses, FIG. 5A shows a case of supplying each of the heaters with single driving pulse with a mutual shift in timing, while FIG. 5B shows a case of supplying each of the heaters with a pre-heating pulse and a main heating pulse with a shift in the timing of the main heating pulse, and FIG. 5C shows a case of supplying the first heater 101 with a single driving pulse and supplying the second heater 102 with a driving pulse composite of a pre-heating pulse and a main heating pulse with a shift in the timing of the single driving pulse. However, as these driving pulses provide similar tendency, FIG. 3 shows only one of these cases.

FIG. 3 indicates, in the nozzle of the aforementioned heater arrangement, that a rapid decrease in the discharge amount is achieved by a slightly earlier timing of bubble generation of the front heater.

Such rapid decrease of the discharge amount mentioned above can be explained from the state of bubble generation in the nozzle. FIGS. 2A to 2F show the states of bubble generation in the nozzle indicating respective elapse times from the bubble generation of the front heater when the bubble a generation by the rear heater is delayed by about 2 $\mu$s from that of the front heater. The above-mentioned phenomenon will be explained in the following with reference to FIGS. 2A to 2F.

Figure 1B:
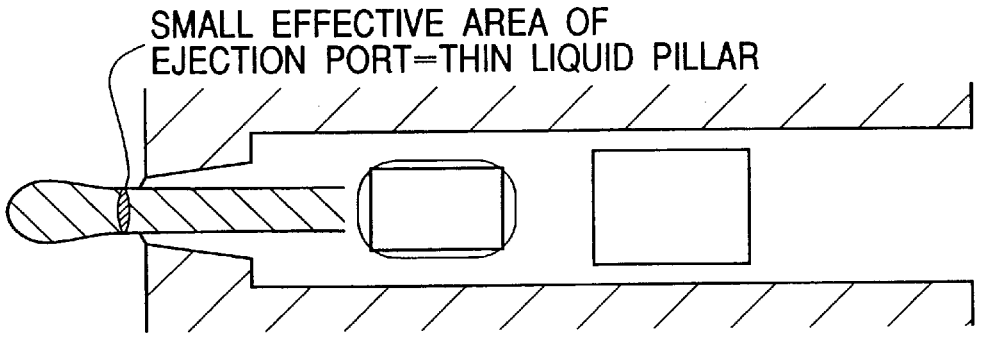
Figures 2A, 2B, 2C, 2D, 2E, 2F:
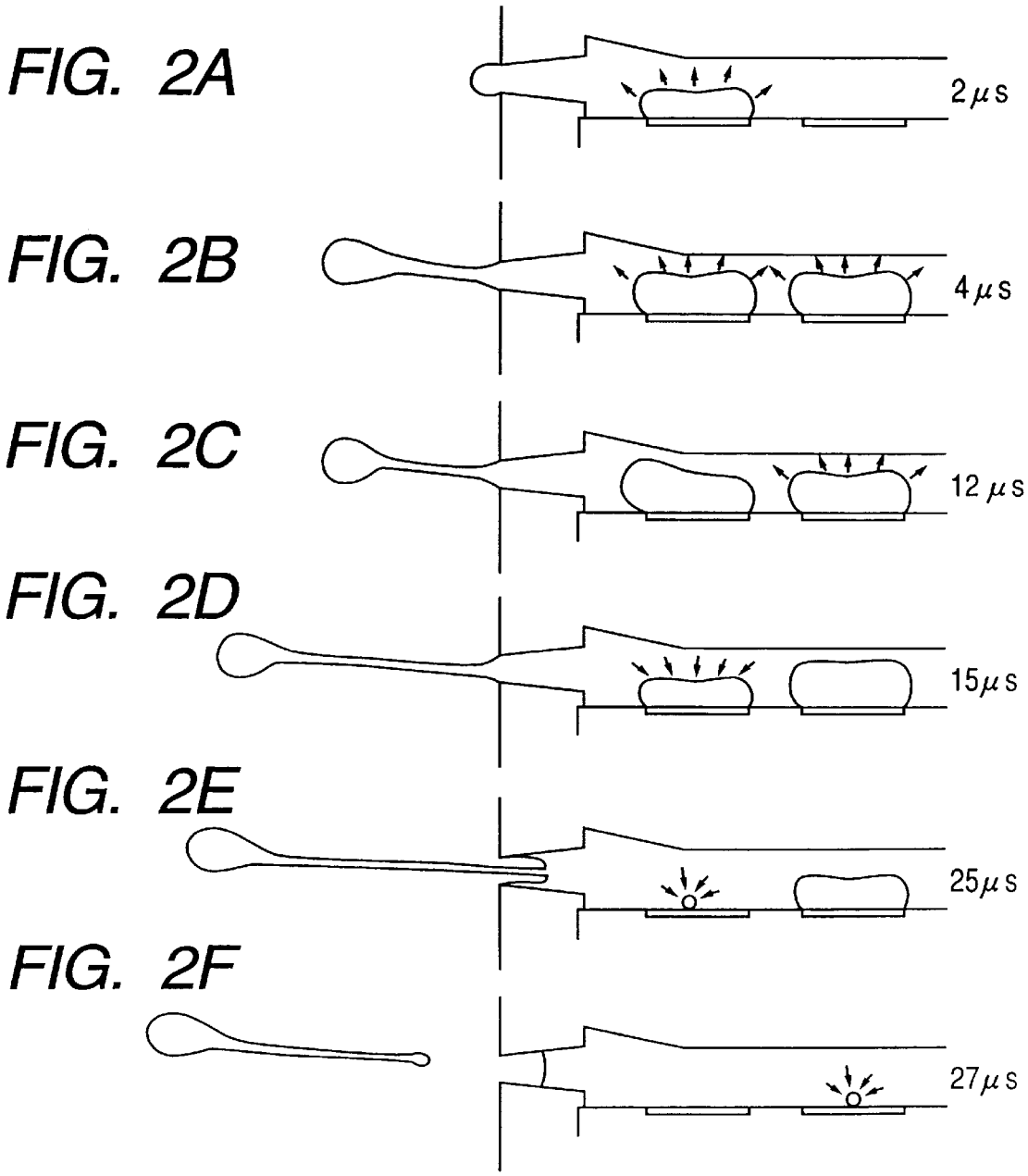
FIGS. 2A, 2B, 2C, 2D, 2E and 2F are views stepwise showing the states of bubble generation in a nozzle when the bubble generation by a rear heater is delayed by 2 $\mu$s from that by a front heater in the ink jet recording head shown in FIGS. 1A to 1C.

When bubble generated is executed by the smaller front heater, a liquid pillar protrudes by the rapid pressure increase, as shown in FIG. 2A. Since the pressure in such state is relatively small, there is formed a thin liquid pillar as shown in FIG. 1B, in which a hatched area suggests a liquid pillar which is going to thereafter protrude from the nozzle. With the protrusion of the liquid pillar, the bubble grows rapidly. Then, when the rear heater executes bubble generation with a delay of 2 $\mu$s, the thin liquid pillar already protrudes by a certain amount from the discharge opening, as shown in FIG. 2B, and the liquid pillar is pushed from the rear and is accelerated. In such state, however, the bubble generated on the front heater already occupies a considerable volume and continues to grow, thus blocking the path of the liquid which is going out from the discharge opening. Since the liquid volume from the front heater to the discharge opening is small, the discharge amount is limited by the blocking of the liquid path by the bubble.

Figure 1C:
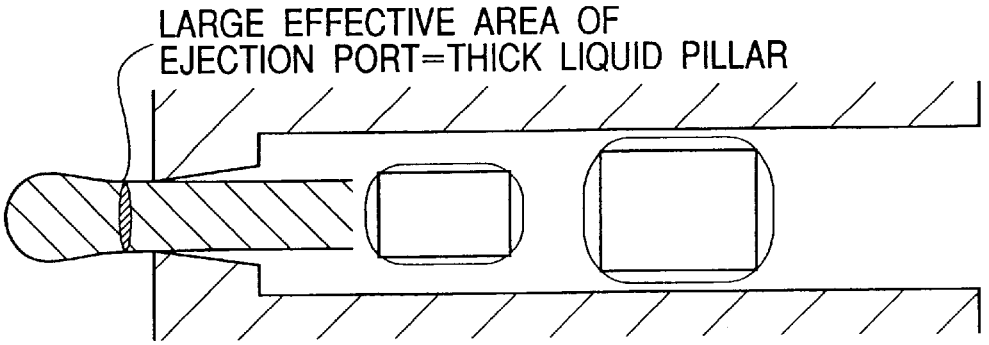

When the bubble generations by the two heaters are conducted approximately simultaneously, a larger pressure acts on the discharge opening in comparison with the above-described bubble generation by the front heater. Consequently, the liquid pillar protruding from the discharge opening becomes thicker, closer to the diameter of the discharge opening, as shown in FIG. 1C, with a larger discharge speed. Thus, the liquid pillar, protruding from the same discharge opening, is different in the thickness between bubble generation by one heater or and that by two heaters, so that an area in appearance of discharge opening (hereinafter called effective discharge opening area) becomes different.

Consequently, in case of simultaneous bubble generations, the liquid pillar from the discharge opening to the front heater occupies a sufficiently large volume and the bubble generated on the front heater is hard to block the liquid path, even if it grows to a large volume. Also, by forming the width of the front heater smaller than the width of the liquid nozzle, a certain amount of liquid can be supplied to the discharge opening through the gaps between the heater and the walls of the liquid nozzle. Consequently, a sufficiently large discharge amount can be obtained by the simultaneous bubble generations of the front and rear heaters.

FIGS. 6A to 6E show the pulse forms in case the front heater is given a single-pulse variable in timing, while the rear heater is given a fixed double-pulse.

Figures 6A, 6B, 6C, 6D, 6E:
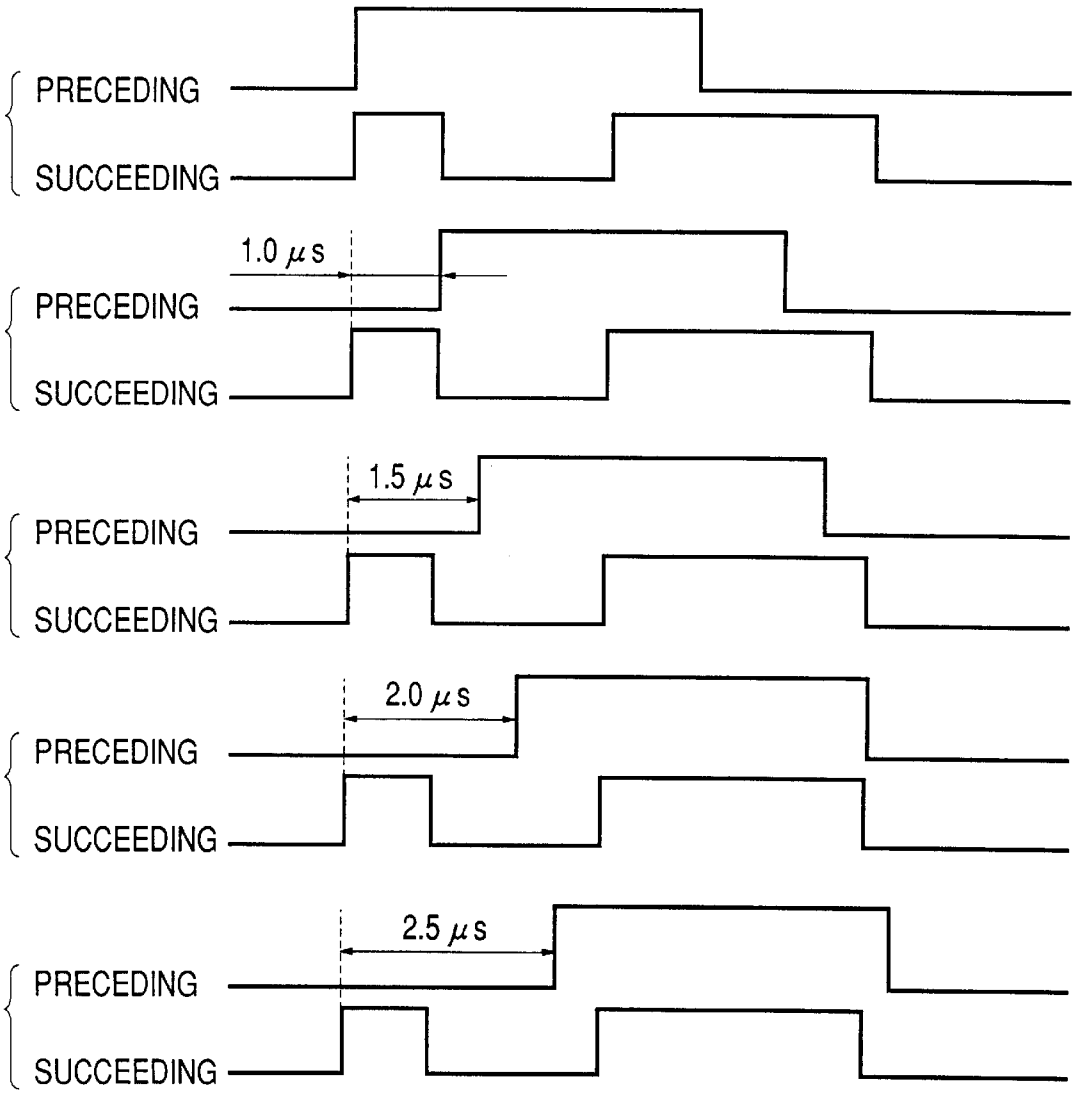
FIGS. 6A, 6B, 6C, 6D and 6E are views showing a single pulse and double pulses respectively applied to the front and rear heaters of the recording head shown in FIGS. 1A to 1C, wherein a wave form of the double pulses is fixed while a timing of the single pulse is varied in different manners.

In an example shown in FIG. 6A, the rear heater is given a double-pulse while the front heater is activated simultaneously with a pre-heating pulse of the double-pulse which does not cause bubble generation in the rear heater, but the bubble generation by the rear heater is delayed by about 2.5 μs from that by the front heater. In this drive, the discharge amount Vd is 15 pl and the discharge speed is 13 m/s.

In examples shown in FIGS. 6B to 6D, the timing of the single-pulse is gradually delayed with respect to the double-pulse in order to obtain simultaneous bubble generations by the pulses. In a reference state shown in FIG. 6E, the timings of drive are so determined that the bubble generations take place substantially simultaneously.

In the state shown in FIG. 6A, the single-pulse is given simultaneously with the pre-heating pulse of the double-pulse, whereby the bubble generation by the rear heater is delayed by about 2.5 μs, with a discharge amount Vd of 15 pl and a discharge speed of 13 m/s.

In the state shown in FIG. 6B, the single-pulse is given with a delay of 1.0 μs from the pre-heating pulse of the double-pulse, whereby the bubble generation by the rear heater is delayed by about 1.5 μs, with a discharge amount Vd of 21 pl and a discharge speed of 15 m/s.

In the state shown in FIG. 6C, the single-pulse is given with a delay of 1.5 μs from the pre-heating pulse of the double-pulse, whereby the bubble generation by the rear heater is delayed by about 1.0 μs, with a discharge amount Vd of 30 pl and a discharge speed of 16.5 m/s.

In the state shown in FIG. 6D, the single-pulse is given with a delay of 2.0 μs from the pre-heating pulse of the double-pulse whereby the bubble generation by the rear heater is delayed by about 0.5 μs, with a discharge amount Vd of 40 pl and a discharge speed of 18 m/s.

In the state shown in FIG. 6E, the single-pulse is given with a delay of 2.5 μs from the pre-heating pulse of the double-pulse, whereby the bubble generations take place almost simultaneously, with a discharge amount Vd of 37 pl and a discharge speed of 17.5 mls. These parameters are summarized in FIG. 13.

As explained in the foregoing, the discharge amount can be varied within a range from 15 to 40 pl, but the change in the discharge speed v is not so large as that in thedischarge amount Vd. In case the front heater alone is activated, the discharge amount Vd is 12 pl and the discharge speed is 10 m/s. Including this drive, the range of change in the discharge amount Vd can be as wide as 12 to 40 pl, and the front heater alone may be activated for example for forming the smallest dot. FIGS. 14A to 14D show driving pulses in this case.

As will be apparent from the foregoing explanation, the driving pulses for the front and rear heaters regarding one dot can be accommodated within a short time. It is therefore rendered possible to achieve high-speed drive by shortening a driving cycle, or namely increasing a driving frequency even in case of gradation recording by modulation with the discharge amount. Also, even in case the discharge amount is varied significantly with modulation of the discharge amount, the discharge speed is stable, and in case the discharge amount is not modulated, the timing of the driving pulses does not fluctuate as long as the discharge amount is in proper range, so that the landing accuracy of the ink droplet is not deteriorated.

Also, the present embodiment allows to significantly vary the discharge amount without significantly affecting the discharge speed, by varying the timing of the single-pulse with respect to that of the double-pulse, thereby enabling reproduction of a wider gradation range.

Other embodiments

In the foregoing embodiment, the discharge amount is controlled by the timing of the single-pulse with respect to that of the double-pulse, but such control is also possible by a change in the duration of the pre-heating pulses of the double pulse.

The pre-heating pulse is applied for pre-heating the ink prior to the application of the main heating pulse, and the pre-heating can control the ink discharge amount by controlling the amount of ink contributing to the bubble generation. In order to prevent the variation in the discharge amount caused by temperature rise in the liquid to be discharged, there is employed control on the width (duration) of the pre-heating pulse. The change in the width of the pre-heating pulse for the rear heater varies the timing of bubble generation thereof, thereby also controlling the discharge amount. For example, a shorter duration of the pre-heating pulse not only reduces the pre-heating but also delays the timing of bubble generation of the rear heater, thereby decreasing the discharge amount.

The discharge amount can also be controlled by the timing of the main heating pulse of the double-pulse. As an example, the timing of bubble generation of the rear heater can be delayed by delaying the timing of drive of the main heating pulse of the double pulse and so reducing the duration thereof that the timing of termination of the main heating pulse remains unchanged, and the discharge amount is reduced as a result.

[Liquid discharging head cartridge]

In the following there will be briefly explained a liquid discharge head cartridge employing the liquid discharge head of the foregoing embodiments.

Figure 9:
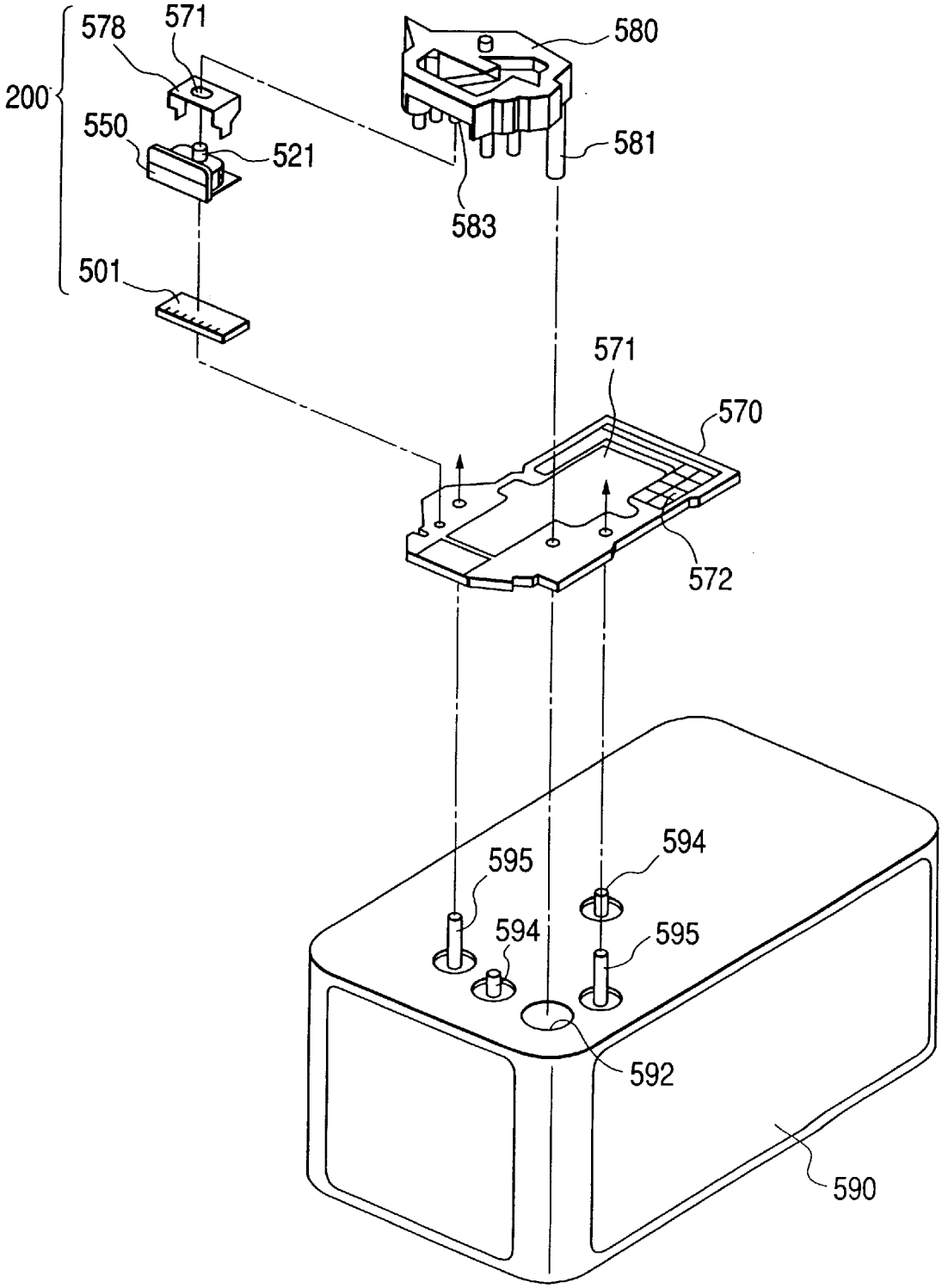
FIG. 9 is an exploded perspective view of a liquid discharging head cartridge.

FIG. 9 is a schematic exploded perspective view of a liquid discharging head cartridge including the above-described liquid discharge head. The cartridge is principally composed of a liquid discharge head unit 200 and a liquid container 580.

The liquid discharge head unit 200 is composed of an element substrate 501, a partition wall 530, a grooved member 550, a pressure spring 578, a liquid element substrate 501 is provided thereon with an array of a plurality of heat generating resistors for heat supply to the liquid, and with a plurality of function elements for selectively driving the heat generating resistors. Liquid paths (not shown), in which the liquid to be discharged flows, are formed by jointing the element substrate 501 and the grooved member 550.

The pressure spring 578 biases the grooved member 550 toward the element substrate 501, and integrally supports the element substrate 501, the grooved member 550 and the support member 570 to be explained later.

The support member 570 is provided for supporting the element substrate 501, etc., and is provided thereon with a circuit board 571 to be connected with the element substrate 501 for the supply of electrical signals thereto, and with contact pads 572 for connection with the main apparatus for exchanging the electrical signals therewith.

The liquid container 590 contains therein liquid such as ink to be supplied to the liquid discharge head. Outside the liquid container 590 there are provided positioning units 594 for providing the connection members for connecting the liquid discharge head and the liquid container, and fixing shafts 595 for fixing the connection members. The liquid is supplied from a liquid supply path 592 of the liquid container, through a supply path 584 of the connection member, to a liquid supply path 581 of the liquid supply member 580, and further to the common liquid chamber through liquid supply paths 583, 571, 521 of the various members.

After the consumption of the liquid, the liquid container may be refilled with the liquid. For this purpose, the liquid container is desirably providedwith a liquid inlet. The liquid discharge head and the liquid container may be constructed integrally or separately.

[Liquid discharge apparatus]

Figure 10:
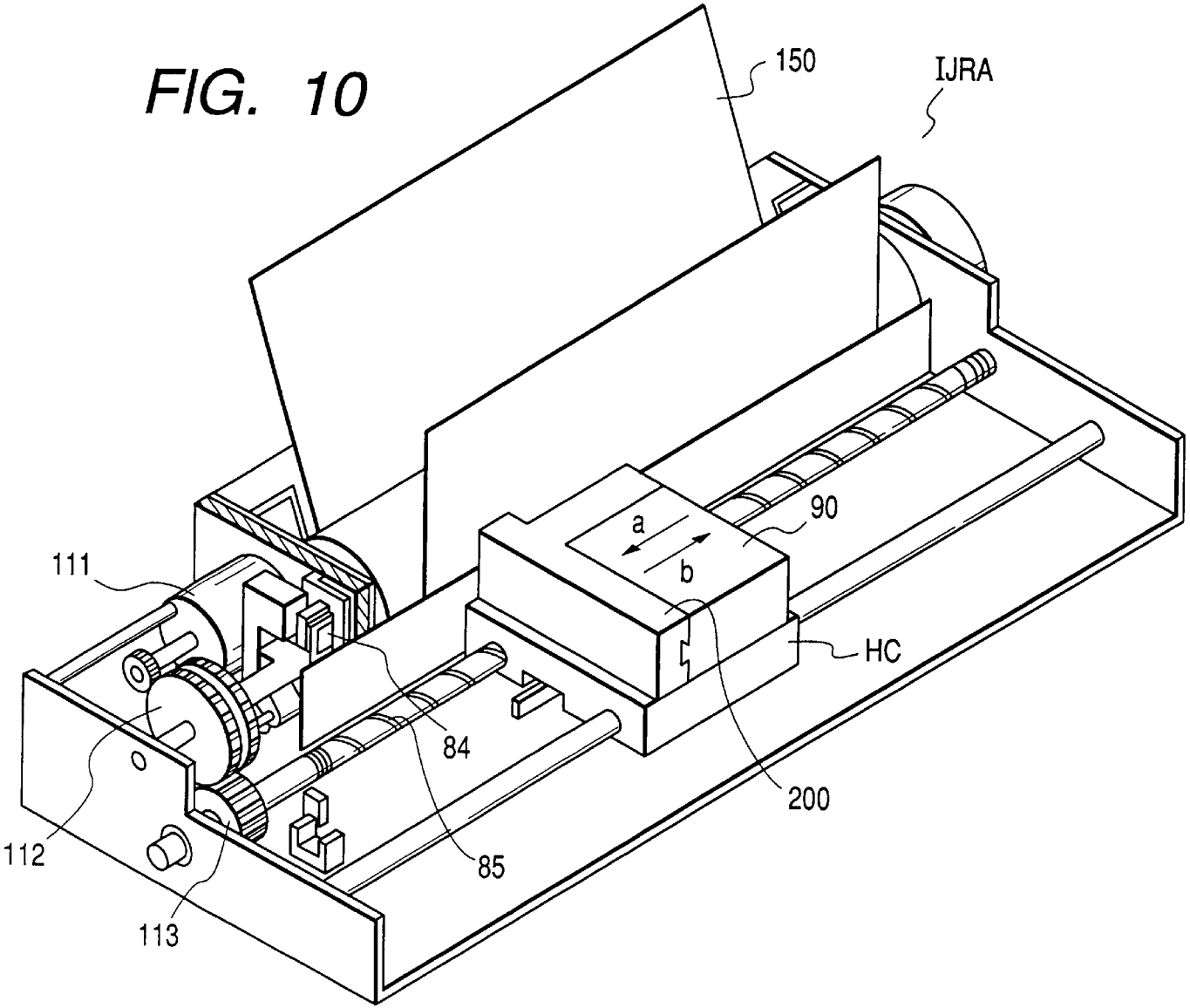
FIG. 10 is a schematic perspective view of a liquid discharging apparatus.

FIG. 10 is a schematic view of a liquid discharge apparatus employing the aforementioned liquid discharge head. In the following, there is taken, as an example, an ink discharge recording apparatus, employing ink as the discharge liquid. A carriage HC supports a head cartridge including a liquid tank 90 for the ink and a liquid discharge head unit 200 in detachable manner, and is reciprocated in the transversal direction of a recording medium 150 such as recording paper, which is transported by recording medium transport means.

In response to a drive signal supplied from unrepresented drive signal supply means to the liquid discharge means on the carriage, the liquid discharge head discharges the recording liquid onto the recording medium.

In the liquid discharge apparatus of the present embodiment, there are provided a motor 111 as drive means for driving the recording medium transport means and the carriage, gears 112, 113 for transmitting the power from the drive means, a carriage shaft 115, etc. The recording apparatus and the liquid discharge method conducted on the recording apparatus provided satisfactory image records by discharging liquid onto various recording media.

Figure 11:
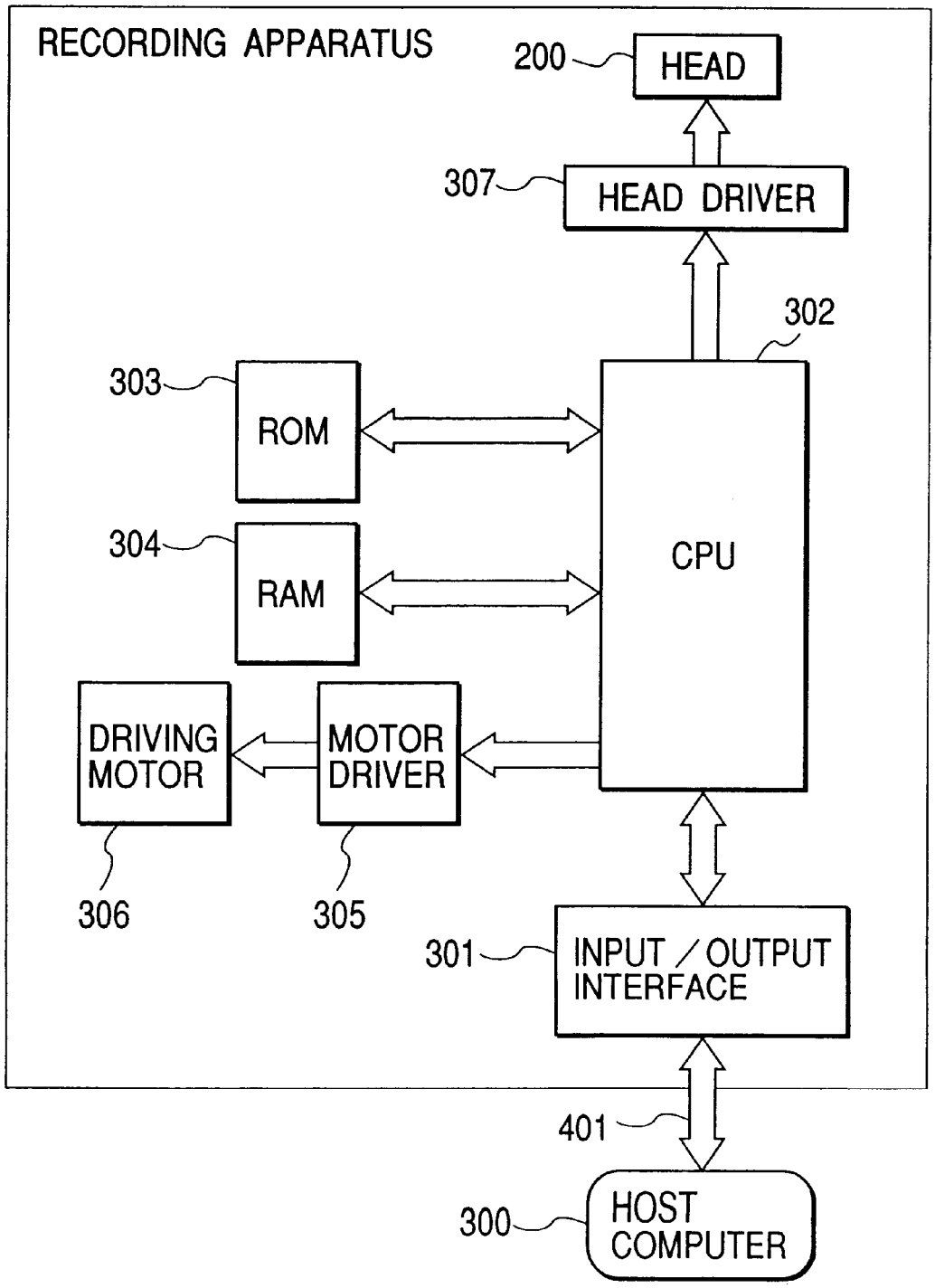
FIG. 11 is a block diagram of the apparatus.

FIG. 11 is a block diagram of the entire apparatus for executing the liquid discharge method of the present invention and the ink discharge recording ration utilizing the liquid discharging head.

The recording apparatus receives print information as as control signals from a host computer 300. The print information is temporarily stored in an input interface 301 in the print engine and is also simultaneously converted into data processable in the recording apparatus, and supplied to a CPU 302, which also serves as head drive signal supply means. Based on a control program stored in a ROM 303, the CPU 302 processes the above-mentioned data entered into the CPU 302, utilizing a RAM 304, etc. thereby converting such data into print data (image data).

The CPU 302 also prepares drive data for driving the motor for displacing the recording paper and the recording head in synchronization with the image data, in order to record the image data in an appropriate position on the recording paper. The image data and the motor driving data are respectively transmitted, through a head driver 307 and a motor driver 305, to a head 200 and a motor 306. Plural heaters provided in each of the discharge heads are activated at the timings explained in the foregoing embodiments, according to the signals supplied from the head driver 307, whereby the liquid is discharged to form an image. The head driver 307 can be of a configuration generating plural pulses of different timings and selecting plural pulses for supply to the head 200 based on a control signal corresponding to the gradational image signal from the CPU 302. The head driver 307 may also be provided in the head 200.

A recording medium usable in the above-described recording apparatus for ink deposition includes various papers, OHP sheet, plastic materials used for compact disk or decorational purposes, fabrics, metals such as aluminum or copper, leather such as cowhide, pigskin or artificial leather, timber, plywood, bamboo, ceramic materials such as tile, and three-dimensionally structured articles such as sponge.

Also, the above-described recording apparatus includes a printer for recording on various papers or OHP sheet, a plastic recording apparatus for recording on plastic materials used for example for compact disk, a metal recording apparatus for recording on metal plates, a leather recording apparatus for recording on leather, a wood recording apparatus for recording on timber, a ceramic recording apparatus for recording ceramic materials, a recording apparatus for recording on three-dimensionally structured articles such as sponge, and a printing apparatus for recording on fabrics.

The discharge liquid to be employed in such liquid discharge apparatus can be designed to match the respective recording medium and recording condition.

In the following, there will be explained an example of the ink jet recording system employing the liquid discharge head of the present invention as the recording head for recording on the recording medium.

Figure 12:
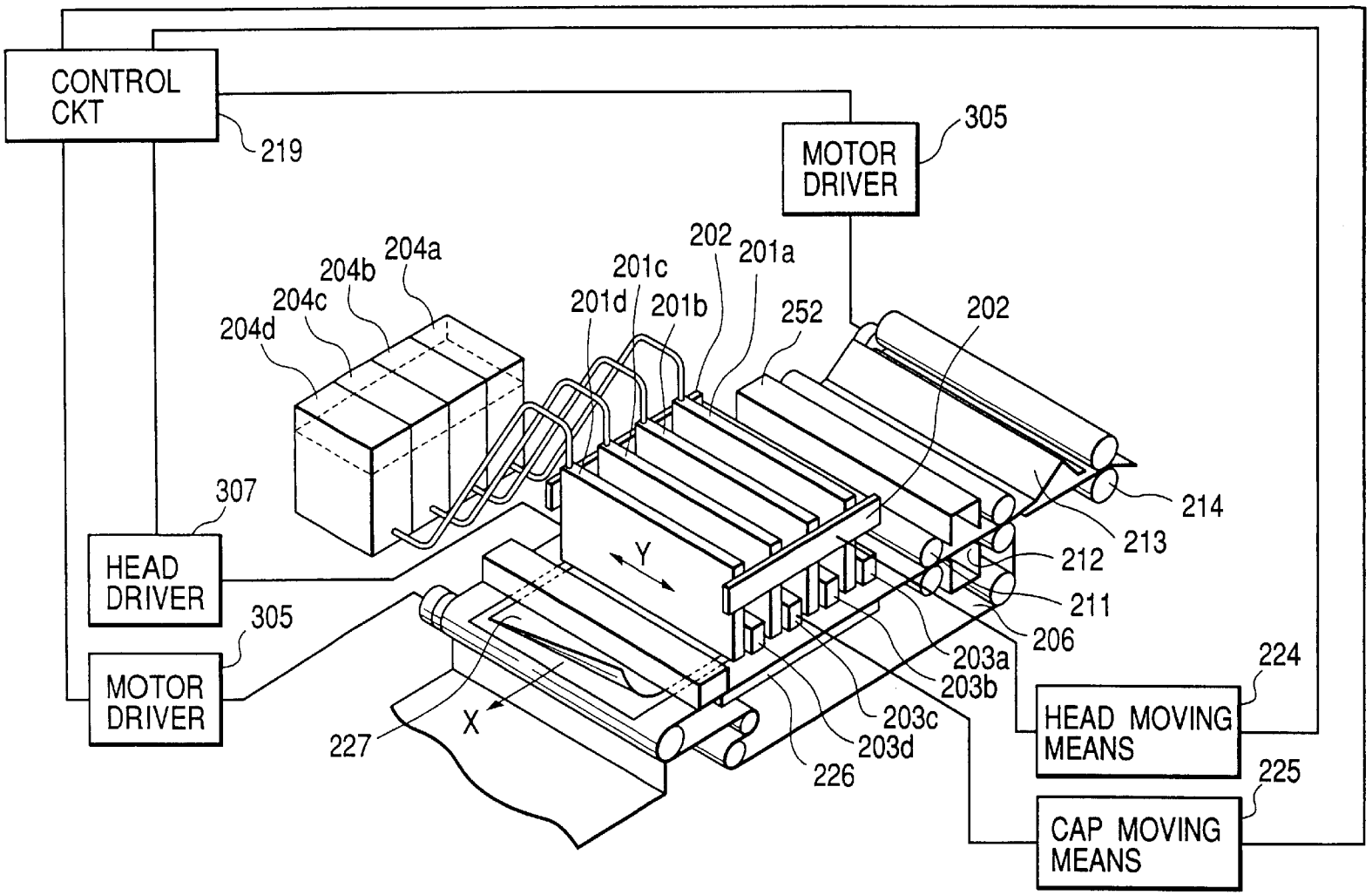
FIG. 12 is a view showing a liquid discharge recording system.
Figures 14A, 14B, 14C, 14D:
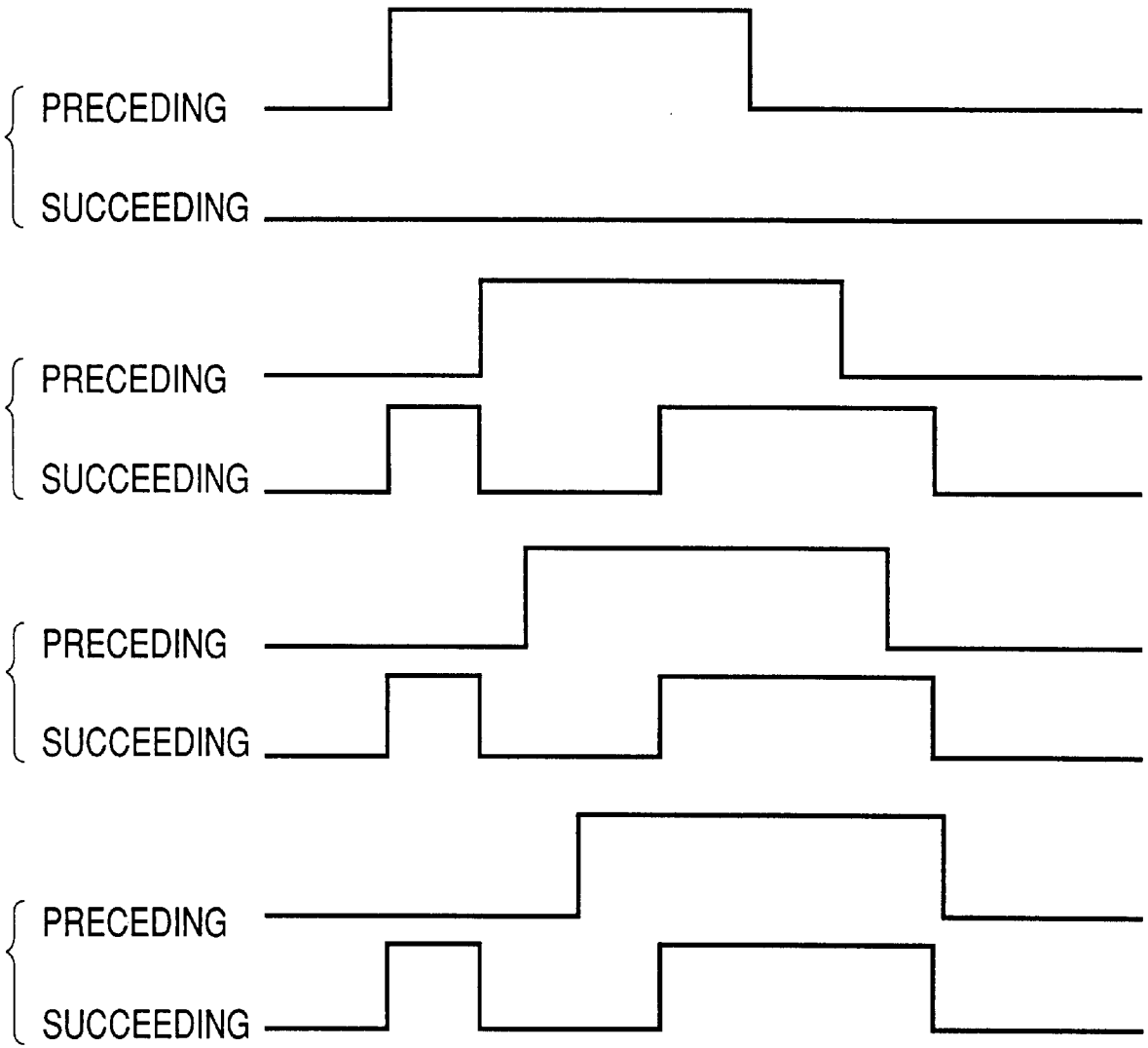
FIGS. 14A, 14B, 14C and 14D are views showing pulses applied to the front and rear heaters of the recording head shown in FIGS. 1A to 1C.

FIG. 12 is a schematic view showing the configuration of an ink jet recording system employing the above-described liquid discharge head 201 of the present invention. The liquid discharge head of the present embodiment is of a full-line type having plural discharge openings with a pitch of 360 dpi and a length corresponding to the recordable width of the recording medium 150, and four heads corresponding to yellow (Y), magenta (M), cyan (C) and black (Bk) colors are fixed and supported, in a mutually parallel manner at a certain pitch in the X direction, by a holder 202.

These heads are respectively given signals from the head driver 307 constituting the drive signal supply means and are driven according to these signals.

Inks of four colors of Y, M, C and Bk are supplied, as the discharge liquids, from ink containers 204*a* to 204*d* to these heads.

Below the heads, there are provided head caps 203*a* to 203*d*, containing ink absorbent members such as sponge therein, and these head caps cover the discharge openings of the heads in the non-recording state, for the purpose of head maintenance.

There is also provided a conveyor belt 206 constituting transport means for transporting various recording media as explained in the foregoing embodiments. The conveyor belt 206 is guided through a predetermined path by various rollers, and is driven by a driving roller connected to the motor driver 305.

Reference numeral 219 denotes a control circuit, 224 denotes a head moving means, and 225 denotes a cap moving means.

In the present embodiment, the recording head is assumed to be composed of a full-line head, but a type of the recording and is not restrictive and there can also be employed a configuration in which the recording is achieved by transporting a small head in the transversal direction of the recording medium.

Furthermore, the ink jet recording apparatus of the present invention is not limited to an image output terminal for an information processing equipment such as a computer, but may also assume a form of a copying apparatus combined with an image reader, or a facsimile apparatus with transmitting and receiving functions.

The present invention, having the above-described configuration, provides the advantages, in modulating the discharge amount with multiple heaters, of enabling high-speed drive and facilitating the driving method, A thereby realizing a liquid discharge recording head with stabilized discharge speed, and a recording method and a recording apparatus utilizing such recording head.

Also the present invention provides, in discharging liquid with multiple heaters, a liquid discharge recording head providing stabilized discharge speed even in the presence of fluctuation in the drive timing, and also enables, in modulating the discharge amount with multiple heaters in a recording method or in a recording apparatus employing such recording head, high-speed drive and an easy driving method, thereby realizing a liquid discharge recording head with stabilized discharge speed, and a recording method and a recording apparatus utilizing such recording head.

What is claimed is:

1. A liquid discharge recording method utilizing two electrothermal transducing members to be driven independently provided in a liquid path communicating with a discharge opening at respectively different distances OH from said discharge opening, and adapted to discharge liquid by bubble generation caused by heat generation in said electrothermal transducing members, said method comprising:

placing an electrothermal transducing member positioned farther from said discharge opening within an area where a ratio v/Vd of a discharge speed v to a discharge amount Vd of the liquid discharged by heating with said electrothermal transducing member remains substantially constant with respect to the distance OH, while placing the other electrothermal transducing member positioned closer to said discharge opening in an area closer to said discharge opening than the above-mentioned range; and relatively delaying the bubble generation by the electrothermal transducing member positioned farther from said discharge opening by a predetermined time from the bubble generation by the electrothermal transducing member positioned closer to said discharge opening, said predetermined time being variable to vary the discharge amount of the liquid.

2. A liquid discharge recording method according to claim 1, wherein, as driving pulses for driving said electrothermal transducing members to generate bubbles, a single pulse is supplied to the electrothermal transducing member positioned closer to said discharge opening and double pulses consisting of a pre-heating pulse not causing bubble generation and a main heating pulse for causing bubble generation are supplied to the electrothermal transducing member positioned farther from said discharge opening.

3. A liquid discharge recording method according to claim 2, wherein the timing of supply of the pre-heating pulse to the electrothermal transducing member positioned farther from said discharge opening is delayed with respect to the timing of supply of the single pulse to the electrothermal transducing member positioned closer to said discharge opening.

4. A liquid discharge recording method according to claim 2, wherein the width of the pre-heating pulse or main heating pulse to the electrothermal transducing member positioned farther from said discharge opening is varied.

5. A liquid discharge recording method according to claim 1, wherein the timing of bubble generation of the electrothermal transducing member positioned farther from said discharge opening is delayed by 0 to 3 $\mu$s with respect to the timing of bubble generation of the electrothermal transducing member positioned closer to said discharge opening.

6. A liquid discharge recording method according to claim 1, wherein said predetermined time is varied according to an image signal having gradation.

7. A liquid discharge recording apparatus utilizing two electrothermal transducing members to be driven independently provided in a liquid path communicating with a discharge opening at respectively different distances OH from said discharge opening, and adapted to discharge liquid by bubble generation caused by heat generation in said electrothermal transducing members, said apparatus comprising:

a recording head in which an electrothermal transducing member positioned farther from said discharge opening is placed within an area where a ratio v/Vd of a discharge speed v to a discharge amount Vd of the liquid discharged by heating with said electrothermal transducing member remains substantially constant with respect to the distance OH, while the other electrothermal transducing member positioned closer to said discharge opening is placed in an area closer to said discharge opening than the above-mentioned range; and drive means for relatively delaying the bubble generation by the electrothermal transducing member positioned farther from said discharge opening by a predetermined time from the bubble generation by the electrothermal transducing member positioned closer to said discharge opening, said predetermined time being variable to vary the discharge amount of the liquid.

8. A liquid discharge recording apparatus according to claim 7, wherein said drive means is adapted to supply, as driving pulses for driving said electrothermal transducing members to generate bubbles, a single pulse to the electrothermal transducing member positioned closer to said discharge opening and double pulses consisting of a pre-heating pulse not causing bubble generation and a main heating pulse for causing bubble generation to the electrothermal transducing member positioned farther from said discharge opening.

9. A liquid discharge recording apparatus according to claim 8, wherein said drive means is adapted to delay the timing of supply of the pre-heating pulse to the electrothermal transducing member positioned farther from said discharge opening with respect to the timing of supply of the single pulse to the electrothermal transducing member positioned closer to said discharge opening.

10. A liquid discharge recording apparatus according to claim 8, wherein said drive means is adapted to vary the width of the pre-heating pulse or the main heating pulse to the electrothermal transducing member positioned farther from said discharge opening.

11. A liquid discharge recording apparatus according to claim 7, wherein said drive means is adapted to delay the timing of bubble generation of the electrothermal transducing member positioned farther from said discharge opening by 0 to 3 μs with respect to the timing of bubble generation of the electrothermal transducing member positioned closer to said discharge opening.

12. A liquid discharge recording apparatus according to claim 7, wherein the electrothermal transducing member positioned closer to said discharge opening is placed within an area where the ratio v/Vd of the discharge speed v to the discharge amount Vd of the liquid discharged by heat generation of said electrothermal transducing member decreases with the increase of the distance OH.

13. A liquid discharge recording apparatus according to claim 7, wherein said drive means is adapted to vary said predetermined time according to an image signal having gradation.

14. A liquid discharge recording head utilizing two electrothermal transducing members to be driven independently provided in a liquid path communicating with a discharge opening at respectively different distances OH from said discharge opening, and adapted to discharge liquid by bubble generation caused by heat generation in said electrothermal transducing members, said head comprising:

a recording head unit in which an electrothermal transducing member positioned farther from said discharge opening is placed within an area where a ratio v/Vd of a discharge speed v to a discharge amount Vd of the liquid discharged by heating with said electrothermal transducing member remains substantially constant with respect to the distance OH, while the other electrothermal transducing member positioned closer to said discharge opening is placed in an area closer to said discharge opening than the above-mentioned range; and a drive unit for relatively delaying the bubble generation by the electrothermal transducing member positioned farther from said discharge opening by a predetermined time from the bubble generation by the electrothermal transducing member positioned closer to said discharge opening, said predetermined time being variable to vary the discharge amount of the liquid.

15. A liquid discharge recording head according to claim 14, wherein said drive unit is adapted to supply, as driving pulses for said electrothermal transducing members to generate bubbles a single pulse to the electrothermal transducing member positioned closer to said discharge opening and double pulses consisting of a pre-heating pulse not causing bubble generation and a main heating pulse for causing bubble generation to the electrothermal transducing member positioned farther from said discharge opening.

16. A liquid discharge recording head according to claim 15, wherein said drive unit is adapted to delay the timing of supply of the pre-heating pulse to the electrothermal transducing member positioned farther from said discharge opening with respect to the timing of supply of the single pulse to the electrothermal transducing member positioned closer to said discharge opening.

17. A liquid discharge recording head according to claim 15, wherein the electrothermal transducing member positioned closer to said discharge opening is placed within an area wherein the ratio v/Vd of the discharge speed v to the discharge amount Vd of the liquid discharged by heat generation of said electrothermal transducing member decreases with the increase of the distance OH.

18. A liquid discharge recording method utilizing independently two electrothermal transducing members to be driven independently provided in a liquid path communicating with a discharge opening at respectively different distances OH from said discharge opening, and adapted to discharge liquid by bubble generation caused by heat generation in said electrothermal transducing members, said method comprising:

placing an electrothermal transducing member positioned farther from said discharge opening within an area where a ratio v/Vd of a discharge speed v to a discharge amount Vd of the liquid discharged by heat generation of said electrothermal transducing member remains substantially constant with respect to the distance OH, while placing the other electrothermal transducing member positioned closer to said discharge opening in an area closer to said discharge opening than the above-mentioned range; and delaying the bubble generation by the electrothermal transducing member positioned farther from said discharge opening relatively from the bubble generation by the electrothermal transducing member positioned closer to said discharge opening, within an area where the discharge amount of the liquid becomes smaller than the discharge amount of the liquid discharged when the bubble generation by the electrothermal transducing member positioned farther from said discharge opening takes place simultaneously with the bubble generation by the electrothermal transducing member positioned closer to said discharge opening.

19. A liquid discharge recording method according to claim 18, wherein, as driving pulses for said electrothermal transducing members to generate bubbles, a single pulse is supplied to the electrothermal transducing member positioned closer to said discharge opening and double pulses consisting of a pre-heating pulse not causing bubble generation and a main heating pulse for causing bubble generation are supplied to the electrothermal transducing member positioned farther from said discharge opening.

20. A liquid discharge recording method according to claim 19, wherein the timing of supply of the pre-heating pulse to the electrothermal transducing member positioned farther from said discharge opening is delayed with respect to the timing of supply of the single pulse to the electrothermal transducing member positioned closer to said discharge opening.

21. A liquid discharge recording method according to claim 19, wherein the width of the pre-heating pulse or the main heating pulse to the electrothermal transducing member positioned farther from said discharge opening is varied.

22. A liquid discharge recording apparatus utilizing two electrothermal transducing members to be driven independently provided in a liquid path communicating with a discharge opening at respectively different distances OH from said discharge opening, and adapted to discharge liquid by bubble generation caused by heat generation in said electrothermal transducing members, said apparatus comprising:

a recording head in which an electrothermal transducing member positioned farther from said discharge opening is positioned in an area where a ratio v/Vd of a discharge speed v to a discharge amount Vd of the liquid discharged by heat generation of said electrothermal transducing member remains substantially constant with respect to the distance OH, while the other electrothermal transducing member positioned closer to said discharge opening is placed in an area closer to said discharge opening than the above-mentioned range; and drive means for delaying the bubble generation by the electrothermal transducing member positioned farther from said discharge opening relatively from the bubble generation by the electrothermal transducing member positioned closer to said discharge opening, within a range in which the discharge amount of the liquid becomes smaller than the discharge amount of the liquid discharged when the bubble generation by the electrothermal transducing member positioned farther from said discharge opening takes place simultaneously with the bubble generation by the electrothermal transducing member positioned closer to said discharge opening.

23. A liquid discharge recording apparatus according to claim 22, wherein said drive means is adapted to supply, as driving pulses for said electrothermal transducing members to generate bubbles, a single pulse to the electrothermal transducing member positioned closer to said discharge opening and double pulses consisting of a pre-heating pulse not causing bubble generation and a main heating pulse for causing bubble generation to the electrothermal transducing member positioned farther from said discharge opening.

24. A liquid discharge recording apparatus according to claim 23, wherein said drive means is adapted to delay the timing of supply of the pre-heating pulse to the electrothermal transducing member positioned farther from said discharge opening with respect to the timing of supply of the single pulse to the electrothermal transducing member positioned closer to said discharge opening.

25. A liquid discharge recording apparatus according to claim 23, wherein said drive means is adapted to vary the width of the pre-heating pulse or the main heating pulse to the electrothermal transducing member positioned farther from said discharge opening.

26. A liquid discharge recording apparatus according to claim 23, wherein the electrothermal transducing member positioned closer to said discharge opening is placed within an area where the ratio v/Vd of the discharge speed v to the discharge amount Vd of the liquid discharged by heat generation of said electrothermal transducing member decreases with the increase in the distance OH.

27. A liquid discharge recording head utilizing two electrothermal transducing members provided to be driven independently in a liquid path communicating with a discharge opening at respective different distances OH from said discharge opening, and adapted to discharge liquid by bubble generation caused by heat generation in said electrothermal transducing members, said head comprising:

a recording head unit in which an electrothermal transducing member positioned farther from said discharge opening is positioned within an area where a ratio v/Vd of a discharge speed v to a discharge amount Vd of the liquid discharged by heat generation of said electrothermal transducing member remains substantially constant with respect to the distance OH, while the other electrothermal transducing member positioned closer to said discharge opening is placed in an area closer to said discharge opening than the above-mentioned range; and a drive unit for delaying the bubble generation by the electrothermal transducing member positioned farther from said discharge opening relatively from the bubble generation by the electrothermal transducing member positioned closer to said discharge opening, within a range in which the discharge amount of the liquid becomes smaller than the discharge amount of the liquid discharged when the bubble generation by the electrothermal transducing member positioned farther from said discharge opening takes place simultaneously with the bubble generation by the electrothermal transducing member positionsed closer to said discharge opening.

28. A liquid discharge recording head according to claim 27, wherein said drive unit is adapted to supply, as driving pulses for said electrothermal transducing members to generate bubbles, a single pulse to the electrothermal transducing member positioned closer to said discharge opening and double pulses consisting of a pre-heating pulse not causing bubble generation and a main heating pulse for causing bubble generation to the electrothermal transducing member positioned farther from said discharge opening.

29. A liquid discharge recording head according to claim 28, wherein said drive unit is adapted to delay the timing of supply of the pre-heating pulse to the electrothermal transducing member positioned farther from said discharge opening with respect to the timing of supply of the single pulse to the electrothermal transducing member positioned closer to said discharge opening.

30. A liquid discharge recording head according to claim 28, wherein the electrothermal transducing member positioned closer to said discharge opening is placed within an area where the ratio v/Vd of the discharge speed v to the discharge amount Vd of the liquid discharged by heat generation of said electrothermal transducing member decreases with the increase in the distance OH.

31. A liquid discharge recording method according to claim 1, further comprising a step of:

causing discharge of the liquid by only the bubble generation by the electrothermal transducing member positioned closer to said discharge opening.

32. A liquid discharge recording method according claim 1, wherein said two electrothermal transducing members are different in the area, and further comprising a step of:

causing discharge of the liquid by only the bubble generation by one of said two electrothermal transducing members which has a smaller area.

33. A liquid discharge recording apparatus according to claim 7, wherein said drive means is adapted to cause discharge of the liquid by only the bubble generation by the electrothermal transducing member positioned closer to said discharge opening.

34. A liquid discharge recording head according to claim 7, wherein said two electrothermal transducing members are different in the area, and further comprising a step of:

causing discharge of the liquid by only the bubble generation by one of said two electrothermal transducing members which has a smaller area.

* * * * *

UNITED STATES PATENT AND TRADEMARK OFFICE

CERTIFICATE OF CORRECTION

PATENT NO. : 6,224,181 B1
DATED : May 1, 2001
INVENTOR(S) : Noribumi Koitabashi

It is certified that error appears in the above-identified patent and that said Letters Patent is hereby corrected as shown below:

Column 1,
Line 15, "appartatuses," should read -- apparatuses, --; and
Line 15, "appartus" should read -- apparatus --.

Column 2,
Line 1, "long" should read -- length of time --; and
Line 32, "even" should read -- even where --.

Column 3,
Line 52, "a" should be deleted.

Column 5,
Line 28, "go" should be deleted.

Column 7,
Line 13, "as" should be deleted;
Line 24, "the all" should read -- all the --;
Line 63, "eing" should read -- being --; and
Line 65, "pulse" should read -- pulse is --.

Column 8,
Line 28, "a" should be deleted; and
Line 59, "or" should be deleted.

Column 9,
Line 50, "mls." should read -- m/s. --; and
Line 54, "thedischarge" should read -- the discharge --.

Column 10,
Line 53, "liquid" should read -- liquid supply member 590, a support member 570, etc. The --.

Column 11,
Line 19, "providedwith" should read -- provided with --;
Line 48, "ration" should read -- operation --; and
Line 50, "as as" should read -- as --.

UNITED STATES PATENT AND TRADEMARK OFFICE

CERTIFICATE OF CORRECTION

PATENT NO. : 6,224,181 B1
DATED : May 1, 2001
INVENTOR(S) : Noribumi Koitabashi

It is certified that error appears in the above-identified patent and that said Letters Patent is hereby corrected as shown below:

Column 12,
Line 25, "recording" should read -- recording on --; and
Line 30, "condition." should read -- condition. (paragraph) [Recording system] --.

Column 13,
Line 14, "A" should be deleted.

Column 18,
Line 41, "according" should read -- according to --; and
Line 52, "head" should read -- apparatus --.

Signed and Sealed this

Ninth Day of July, 2002

*Attest:*

*Attesting Officer*

JAMES E. ROGAN
*Director of the United States Patent and Trademark Office*